US005401458A

United States Patent [19]

Wadsworth et al.

[11] Patent Number: 5,401,458

[45] Date of Patent: Mar. 28, 1995

[54] MELTBLOWING OF ETHYLENE AND FLUORINATED ETHYLENE COPOLYMERS

[75] Inventors: Larry C. Wadsworth; Ahamad Y. Khan, both of Knoxville, Tenn.

[73] Assignee: Exxon Chemical Patents Inc., Linden, N.J.

[21] Appl. No.: 142,240

[22] Filed: Oct. 25, 1993

[51] Int. Cl.[6] ..... D01D 5/14; D01F 6/28

[52] U.S. Cl. ..... 264/555; 264/175; 264/210.8; 264/211.17

[58] Field of Search ..... 264/175, 210.8, 211.14, 264/211.17, 555

[56] References Cited

U.S. PATENT DOCUMENTS

| | | | |
|---|---|---|---|
| 3,650,866 | 3/1972 | Prentice | 156/181 |
| 3,942,723 | 3/1976 | Langdon | 239/135 |
| 4,818,463 | 4/1989 | Buehning | 264/555 X |
| 4,857,251 | 8/1989 | Nohr et al. | 264/555 X |
| 4,986,743 | 1/1991 | Buehning | 425/7 |
| 5,145,689 | 9/1992 | Allen et al. | 425/72.2 |

*Primary Examiner*—Leo B. Tentoni
*Attorney, Agent, or Firm*—D. W. Miller

[57] ABSTRACT

High MI, high MP ethylene-fluorinated ethylene copolymers (preferably ECTFE) are meltblown through relatively large orifices. The web produced by the process is characterized by low fiber size and high strength.

14 Claims, No Drawings

MELTBLOWING OF ETHYLENE AND FLUORINATED ETHYLENE COPOLYMERS

BACKGROUND OF THE INVENTION

This invention relates generally to meltblowing and in particular to meltblowing of ethylene-chlorotrifluoroethylene copolymers and ethylene-tetrafluoroethylene copolymers.

Meltblowing is a process for producing microsized nonwoven fabrics and involves the steps of (a) extruding a thermoplastic polymer through a series of orifices to form side-by-side filaments, (b) attenuating and stretching the filaments to microsize by high velocity air, and (c) collecting the filaments in a random entangled pattern on a moving collector forming a nonwoven fabric. The fabric has several uses including filtration, industrial wipes, insulation, battery separators, diapers, surgical masks and gowns, etc. The typical polymers used in meltblowing include a wide range of thermoplastics such as propylene and ethylene homopolymers and copolymers, ethylene acrylic copolymers, nylon, polyamides, polyesters, polystyrene, polymethylmethacrylate, polyethyl, polyurethanes, polycarbonates, silicones, poly-phemylene, sulfide, polyethylene terephthalate, and blends of the above.

The ethylene-fluorocarbon copolymers, particularly ethylene-chlorotrifluoroethylene (ECTFE), contribute useful properties to the nonwoven fabric. For example, the ECTFE is strong, wear resistant, resistant to many toxic chemicals and organic solvents. However, these polymers are difficult to meltblow to small fiber size. Tests have shown that meltblowing of ECTFE using conventional ECTFE resins, techniques, and equipment produces fibers having an average size (D) of about 8 microns, which is substantially larger than the useful range in many applications, particularly filtration. For comparison, polypropylene webs meltblown under the same conditions would have an average fiber size (D) between about 1 and 3 microns.

One of the variables in the meltblown process is the size of the die orifices through which the thermoplastic is extruded. Two popular types of meltblowing dies are disclosed in U.S. Pat. Nos. 4,986,743 and 5,145,689. The die disclosed in U.S. Pat. No. 4,986,743 manufactured by Accurate Products Company is available with orifices ranging from 0.010 to 0.025 inches (0.25 to 0.63 mm); while the die disclosed in U.S. Pat. No. 5,145,689, manufactured by J & M Laboratories, is available with orifices ranging from 0.010 to 0.020 inches (0.25 to 0.50 mm) for web forming polymers.

There is a need to improve the meltblowing process and/or fluorocarbon resins to achieve relatively low fiber size increasing their utility in a variety of uses.

SUMMARY OF THE INVENTION

Surprisingly, it has been discovered that by meltblowing high melt index, high melting point fluorocarbon copolymers through relatively large orifices, the average fiber size (D) of the non-woven web can be dramatically reduced and the web strength properties significant improved.

In accordance with the present invention, an ethylene-fluorocarbon copolymer, specifically a copolymer of ethylene and chlorofluoroethylene (ECTFE) or tetrafluoroethylene (ETFE), is meltblown through orifices having a diameter of greater than 25 mil (0.63 mm). The melt index of the copolymer is at least 100 and the melting point of at least 240° C. The meltblowing process is carried out wherein the polymer velocity through the orifices is preferably less than 150 centimeters per minute per hole. The preferred copolymer is ECTFE.

The nonwoven fabric produced by the process is characterized by improved breaking loads in both the machine direction (MD) and the cross direction (CD) of the meltblown web.

DESCRIPTION OF THE PREFERRED EMBODIMENTS

As mentioned above, the thermoplastics useable in the method of the present invention fall into the class identified as ethylene/fluorinated ethylene copolymers, referred to generically herein as fluorocarbon copolymers. Specifically, the preferred copolymers are ethylene-chlorotrifluoro-ethylene (ECTFE) and ethylene-tetrafluoroethylene (ETFE), with the former being more preferred.

The properties of these copolymers which are important in meltblowing are as follows:

- melting point (MP): the temperature at which the solid polymer passes from the solid to a viscous liquid.
- melt index (MI): the number of grams of a thermoplastic polymer that can be forced through a 0.0825 inch orifice in 10 minutes at 190° C. and a pressure of 2160 grams.
- glass transition temperature ($T_g$): the temperature at which a polymer changes from a brittle, vitreous state to a plastic state.

In order to appreciate how these properties influence the behavior of the fluorocarbon copolymers - not only in the meltblowing process but in the resulting web produced thereby - it is necessary to understand the meltblowing process.

Meltblowing equipment for carrying out the process generally comprises an extruder, a meltblowing die, a hot air system, and a collector. A polymer melt received by the die from the extruder is further heated and extruded from a row of orifices as fine filaments while converging sheets of hot air (primary air) discharging from the die contact the filaments and by drag forces stretch the hot filaments to microsize. The filaments are collected in a random entangled pattern on a moving collector screen such as a rotating drum or conveyor forming a nonwoven web of entangled microsized fibers. (The terms "filaments" and "fibers" are used interchangeably herein). The filaments freeze or solidify a short distance from the orifice aided by ambient air (secondary air). Note, however, that the filament stretching by the primary air drag forces continues with the filaments in the hot solidified or semi-solidified state.

The die is the key component of the meltblowing line and typically comprises the following components:

(a) A heated die body having polymer flow passages and air flow passages formed therein.

(b) A die tip mounted on the die body and having a triangular nosepiece terminating in an apex. Formed in the apex are a row of orifices through which the polymer melt is extruded.

(c) Air plates mounted on opposite sides of the nosepiece and therewith define air slots through which the hot air discharges convergingly at the apex of the nosepiece.

The converging sheets of hot air thus impose drag forces on the hot filaments emerging from the orifices. These forces stretch and attenuate the filaments to the extent that the filaments collected on the collector have an average size which is a small fraction of that of the filaments extruded from the orifices.

The construction of the meltblowing die may take a variety of forms as evidenced by the numerous patents in this area. Examples of such patents include U.S. Pat. Nos. 4,818,463; 5,145,689; 3,650,866; and 3,942,723, the disclosures of which are incorporated herein by reference for purposes of disclosing details of meltblowing dies.

Regardless of the specific construction of the dies, however, important equipment variables that affect the meltblowing process are as follows:

- orifice size (D): the diameter of the holes through which the polymer melt is extruded.
- orifices per inch: as measured along the length of the nosepiece.
- orifices L/D: the length/diameter of the orifices.
- die to collector distance (DCD): the distance between the orifices and the collector.
- polymer velocity per hole (V): the speed at which the polymer melt flows through an orifice.
- air gap: the width of the air slots in the die.
- setback: the position of the apex in relation to the air plates as measured along the axes of the orifices in the die.
- die temperature: the temperature maintained in the die.
- primary air temperature: the temperature of the air discharging from the die.

Conventional knowledge in the industry, confirmed to a degree by experiments, would suggest that there is a proportional relationship between the orifice size and the size of the filaments collected on the collector; that is, large orifices would produce large filaments and, similarly, smaller orifices would produce smaller filaments, at the same meltblowing conditions. Tests have shown using polypropylene that the effect of varying orifice sizes did not produce a significant difference in the web filament size.

In accordance with the present invention, however, it has been discovered that the melt-blowing of high melt index, high melting point ethylene-fluorocarbon copolymers through large orifices, in fact, produces smaller diameter filaments. The copolymers have a melt index of at least 100, a melting point of at least 200° C., and the meltblowing die has orifices of greater than 25 mils (0.63 mm).

Experiments have shown that meltblowing ECTFE through 30 mil (0.76 mm) orifices produces filaments 25 percent smaller in diameter than meltblowing the same polymer through the conventional 15 mil (0.38 mm) orifices.

In the preferred embodiment of the present invention, the polymer is ECTFE having a Melt Index of at least 300 and the orifices have a diameter of at least 27 mil (0.68 mm).

Although the reasons for the surprising results are not fully understood, it is believed that at least two mechanisms are involved, both of which delay the cooling of the filaments thereby enabling the primary air drag forces to act longer on the hot filaments. This increases the stretching and attenuation between the die and the collector resulting in much smaller filaments. The two mechanisms are (a) increased mass of the filaments flowing through the larger orifices, and (b) the high melting point of the thermoplastics. The increased mass of the larger filaments extruded from the orifices takes longer to cool, vis-a-vis thinner filaments, and the high melting point and high $T_g$ of the thermoplastic result in slower cooling. Also, the slower velocity through the larger orifices increases the residence time and may contribute to more filament stretching by the relatively high velocity primary air.

For purposes of the present invention, the preferred process variables are summarized below:

| | Range | Preferred | Most Preferred |
|---|---|---|---|
| Orifice Size (D) (mils) | >25[2] | 27–35 | 30 |
| Velocity (V)[1] (cm/min.) | <150 | 40–100 | 40–60 |
| Orifice Area, ($mm^2$) | >0.31 | 0.36–0.62 | 0.45 |

[1]polymer flow through an orifice
[2]The upper limit of the orifice size will be determined by the orifice size in which meltblown webs can be formed, and will generally be about 40 mils.

The properties of the ethylene-fluorocarbon copolymers which are important in characterizing the polymers for use in the process of the present invention are as follows:

| ECTFE and ETFE | Range | Preferred | Most Preferred |
|---|---|---|---|
| Ethylene monomer content (wt %) | 30–70 | 40–60 | 50 |
| MP (°C.) | — | — | 240° |
| MI | 100–1500 | 300–1000 | 400–800 |
| MW | — | 80,000–120,000 | about 100,000 |
| $T_g$ (°C.) | — | — | 80 |

The web properties of the fluorocarbon produced by the method of the present invention are summarized below:

| Web Properties | Broad Range | Preferred Range | Most Preferred Range |
|---|---|---|---|
| Fiber Diameter Average (um) | 1.00–3.50 | 1.5–3.20 | 2.00–3.00 |
| Packing Factor | >0.1 | .11–.15 | .11–.14 |
| MD Break Load, (g/in.) | >400[1] | >450[1] | >500[1] |
| MD Break, Elong, (%) | 2–8 | 3–7 | 4 |
| CD Break Load, (g/in.) | >1000[1] | >1500[1] | >2000[1] |
| CD Break, Elong, (%) | 75–120 | 80–110 | 90–105 |

[1]The upper limits will be maximum attainable which to date has been about 1500 for MD and about 5000 for CD.

The values presented in the above tables for the broad, preferred, and most preferred ranges are interchangeable.

The web produced by the process is soft and possesses excellent strength in both the MD and CD, and because of its resistance to flame, and toxic materials, has a variety of uses not possible with conventional meltblown webs (e.g. PP). It should be noted that further treatment of the web as by calendering at elevated temperatures (e.g. 70° C. to 85° C.) will further increase the strength of the web.

The meltblowing operation in accordance with the present invention is illustrated in the following examples carried out on a six-inch die.

EXPERIMENTS

Experiments were carried out to compare the effects of increased orifice size (D) on both conventional meltblown polymers (PP) and high melt index ECTFE.

In the Series I tests, the meltblown equipment and process conditions were as follows:

Orifice (D): 15 mil
Orifices per inch: 20
L/D: 15/1
DCD: 3.5–4.6
Air Gap: 0.060 inches
Setback: 0.060 inches
Die Temp: 490° F. (254° C.)
Primary Air Temp: 547° F. (256° C.)
Polymer Flow Rate: 0.58 g/min/orifice In the Series II tests, the meltblown equipment and process conditions were as follows:

Orifice size (D): 15 mil (0.38 mm) and 30 mil (0.76 mm)
Orifices per inch: 20
L/D: 10/1 inches
DCD: 4.0 inches
Air Gap: 0.1 inch
Setback: 0.064 inches
Die Temp: 500° F.
Primary Air Temp: 540° F.
Basis Weight: 2.65 oz./yd$^2$ (90 g/m$^2$)
Polymer Flow Rate: 0.4 g/min/orifice Series III tests were the same as the Series II tests except the DCD was varied between 3.5 and 5.0, and the polymer flow rate was varied between 0.4 and 0.6 g/min./orifice.

The evaluations of the meltblown webs produced by the experiments were in accordance with the following procedures:

Fiber Size Diameter - measured from magnified scanning electron micro-graphs.

Filtration Efficiency - measured with a sodium chloride aerosol with 0.1 um particle size with a 0.05 m/sec. The mass concentration of sodium chloride in air was 0.101 g/L.

Air Permeability (Frazier) - ASTM Standard D737-75.

Burst. Strength - ASTM D3786-87.

Packing Factor - Actual mass of 75 mm by 75 mm piece of web divided by calculated mass of same size web assuming a 100% solid polymer piece.

Breaking Load - ASTM D1117-80

The polymers used in the experiments were as follows:

| Sample | Type | M.I. | M.P. (°C.) |
|---|---|---|---|
| SERIES I: | | | |
| A | ECTFE[1] | 26 | 229 |
| B | ECTFE[1] | 45 | 240 |
| C | ECTFE[1] | 142 | 240 |
| D | ECTFE[1] | 358 | 240 |
| SERIES II: | | | |
| E | PP[2] | 850 | 163 |
| F | ECTFE[1] | 566 | 240 |
| SERIES III: | | | |
| G | ECFT[1] | 358 | 240 |

[1]Tradename "Halar" marketed by Ausimont USA, Inc.
[2]850 MFR PP marketed by Exxon Chemical Company as Grade PD3545G The results of the Series I and II tests are presented in TABLE I.

TABLE I

| Web Sample | Orifice Size (mil) | Average Fiber D (um) | Packing Factor | MD Break (g/in) | MD elong at Break (%) | CD Break (g/in) | CD elong at Break (%) |
|---|---|---|---|---|---|---|---|
| A | 15 | | (Poor quality, gritty coarse web) | | | | |
| B | 15 | | (No web formed) | | | | |
| C | 15 | 8.3 | | 123 | 2.6 | 562 | 181 |
| D | 15 | 8.0[1] | | 307 | 4.2 | 731 | 134 |
| E-1 | 15 | 1.99 | | | | | |
| E-2 | 30 | 1.84 | | | | | |
| F-1 | 15 | 3.83 | 0.095 | 372 | 1.7 | 962 | 70.9 |
| F-2 | 30 | 2.87 | 0.127 | 1729 | 5.7 | 3482 | 101.2 |
| G-1 | 15 | 7.90 | | | | | |
| G-2 | 30 | 4.74[2] | | | | | |
| G-3 | 30 | 3.24[3] | | | | | |

[1]avg. of two runs
[2]avg. of two runs and DCD of 3.5 and 5.0 and flow rate of 0.6 g/min./orif.
[3]avg. of two runs and DCD of 3.5 and 5.0 and flow rate of 0.4 g/min./orif.

A comparison of the ECTFE samples (Samples C and D) meltblown at conventional orifice size of 15 mil reveals that there is an improvement in the web strength by increasing the M.I. However, the degree of improvement resulting from the use of the larger holes, with all other conditions remaining the same, is remarkable as illustrated by the following side-by-side comparison of Samples F-1 and F-2:

TABLE II

| | Orifice Size | |
|---|---|---|
| | 15 mil (Sample F-1) | 30 mil (Sample F-2) |
| Polymer | ECTFE | ECTFE |
| M.I. | 566 | 566 |
| Avg. Fiber Diameter (um) | 3.83 | 2.87 |
| Bursting Strength (Psi) | 14 | 8.5 |
| Packing Factor | 0.095 | 0.127 |
| Filtration Eff. (%) | 51.7 | 50.80 |
| MD Break (g/in) | 372 | 1729 |
| MD Break, elong (%) | 1.7 | 5.7 |
| CD Break, (g/in) | 962 | 3482 |
| CD Break, elong (%) | 70.9 | 101.2 |

The larger size orifices not only reduced the average particle size by 25%, but also dramatically improved the MD and CD properties. Series II tests using high MI polypropylene (Samples E-1 and E-2) revealed that the fiber size was reduced only marginally (7%) by using the larger orifices (30 mil vs. 15 mil).

The Experiments on ECTFE demonstrate that three factors play a significant role in achieving the improved results of reduced average fiber diameter and improved strengths: (1) larger orifices, (2) high MI, and (3) high MP.

What is claimed is:

1. In a melt blowing process wherein thermoplastic polymer is extruded from a plurality of orifices, attenuating and stretching filaments formed by the thermoplastic polymer by converging air streams, and collecting the filaments, the improvement wherein the thermoplastic polymer is an ethylene-fluorocarbon copolymer having a melt index of at least of 100 and melting point of at least 200° C. and wherein each orifice has a flow area greater than 0.31 $mm^2$.

2. The method of claim 1 wherein the copolymer comprises from 30 to 70 wt. % ethylene.

3. The method of claim 2 wherein the copolymer is selected from the group consisting of ethylene-chlorotrifluoroethylene and ethylene-tetrafluoroethylene.

4. The method of claim 3 wherein the copolymer is ethylene-chlorotrifluoroethylene.

5. The method of claim 4 wherein the ethylene content of the copolymer ranges from 40 to 60 wt. % and the chlorotrifluoroethylene content ranges from 60 to 40 wt. %.

6. The method of claim 1 wherein the polymer has a melting point of at least 240° C.

7. The method of claim 1 wherein each orifice has a diameter greater than 25 mils (0.63 mm)

8. The method of claim 1 wherein the polymer flow velocity through each orifice is less than 150 cm/min.

9. The method of claim 1 wherein the copolymer has an MI of at least 300.

10. The method of claim 1 wherein the copolymer has an MI of at least 400.

11. The method of claim 7 wherein the diameter of each orifice is between 0.27 mil (0.68 mm) and 0.35 mil (0.89 mm).

12. The method of claim 11 wherein the orifice diameter is equal to or greater than 30 mil (0.76 mm).

13. A meltblowing process which comprises:

(a) meltblowing ethylene-chlorotrifluoro-ethylene through a plurality of orifices at a flow velocity of less than 150 cm/min/orifice forming a plurality of filaments, each orifice having a flow area of at least 0.36 $mm^2$, said ECTFE having a melt index of greater than 300;

(b) contacting the filaments with air to stretch the filaments to an average diameter of less than 3 um; and (c) collecting the filaments on a collector forming a nonwoven web of microsized filaments.

14. The meltblowing process of claim 13 and further comprising calendering the web formed in step (c).

* * * * *